US007673861B2

(12) United States Patent
Meholovitch et al.

(10) Patent No.: US 7,673,861 B2
(45) Date of Patent: Mar. 9, 2010

(54) VISE WITH QUICK RELEASE FEATURE

(75) Inventors: David Meholovitch, Glendora, CA (US); Walt Kopala, Corona, CA (US); Lisa Kopala, legal representative, Corona, CA (US)

(73) Assignee: Thorsen Tools, Inc., Ontario, CA (US)

( * ) Notice: Subject to any disclaimer, the term of this patent is extended or adjusted under 35 U.S.C. 154(b) by 146 days.

(21) Appl. No.: 11/832,063

(22) Filed: Aug. 1, 2007

(65) Prior Publication Data

US 2008/0029947 A1 Feb. 7, 2008

Related U.S. Application Data

(60) Provisional application No. 60/821,110, filed on Aug. 1, 2006.

(51) Int. Cl.
*B25B 1/02* (2006.01)

(52) U.S. Cl. ..... 269/181; 269/43; 269/179

(58) Field of Classification Search ..... 269/181, 269/43, 41, 178–179
See application file for complete search history.

(56) References Cited

U.S. PATENT DOCUMENTS

| | | | | |
|---|---|---|---|---|
| 4,923,185 | A * | 5/1990 | Fan | 269/181 |
| 6,050,559 | A * | 4/2000 | de Souza | 269/208 |
| 6,427,993 | B1 * | 8/2002 | Prochac | 269/37 |
| 6,595,508 | B2 * | 7/2003 | Duncan | 269/242 |
| 6,896,249 | B1 * | 5/2005 | Ferrara | 269/154 |
| 7,293,765 | B2 * | 11/2007 | Hooper | 269/246 |
| 2008/0029947 | A1 * | 2/2008 | Meholovitch et al. | 269/181 |

* cited by examiner

*Primary Examiner*—Lee D Wilson
(74) *Attorney, Agent, or Firm*—Patterson & Sheridan, L.L.P.

(57) ABSTRACT

A method and apparatus for clamping a workpiece in a vise. The apparatus generally includes a stationary jaw with a first gripping surface and a moveable jaw with a second gripping surface connected and operated by a spindle. The spindle moves the stationary jaw and the moveable jaw toward and away for each other when rotated. The vise includes an actuation rod configured to engage and disengage a semi-nut from the spindle thereby engaging and disengaging the moveable jaw from the fixed jaw in order to allow an operator to quickly move the moveable jaw by hand.

10 Claims, 9 Drawing Sheets

VISE WITH QUICK RELEASE FEATURE

CROSS-REFERENCE TO RELATED APPLICATIONS

This application claims benefit of U.S. Provisional Patent Application Ser. No. 60/821,110, filed Aug. 1, 2006, and U.S. Ser. No. 29/248,180, filed Aug. 1, 2006. These application are incorporated herein in their entirety.

BACKGROUND OF THE INVENTION

1. Field of the Invention

Embodiments of the present invention generally relate to a hand tool and more particularly to a vise. More particularly still, embodiments of the invention relate to a table top mounted vise with improved performance and utility.

2. Description of the Related Art

Vises are used in order to temporarily hold one or more objects so that work can be performed on them. Traditional table top mounted vises have existed for years. A typical vise is composed of a stationary jaw with a base that can be mounted to a surface. There is a moveable jaw and a guide rod(s) that allows the moveable jaw to move smoothly toward and away from the stationary jaw. Each jaw has a clamping surface for holding a work piece. Further, the vise has a screw and lever system which operates the moveable jaw. The screw typically has a relatively fine pitched thread which provides a large mechanical advantage such that a relatively small amount of torque applied to the lever produces a large clamping force between the jaws. The screw moves the moveable jaw whereby the fine pitch required for the large mechanical advantage causes the jaw to move a very small distance with each turn. Thus, adjusting the jaws to different opening sizes for clamping of relatively thin and subsequently relatively thick items (or vice versa) requires numerous turns of the lever attached to the screw. Large adjustments to these vises require several rotations of the screw and thus long periods of time.

Therefore, a need exists for an improved apparatus and method of vise clamping that would allow a user to quickly adjust the opening size of the jaws and apply clamping force to the jaw through the use of one lever.

SUMMARY OF THE INVENTION

The present invention generally relates to a method and apparatus for clamping a work piece.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
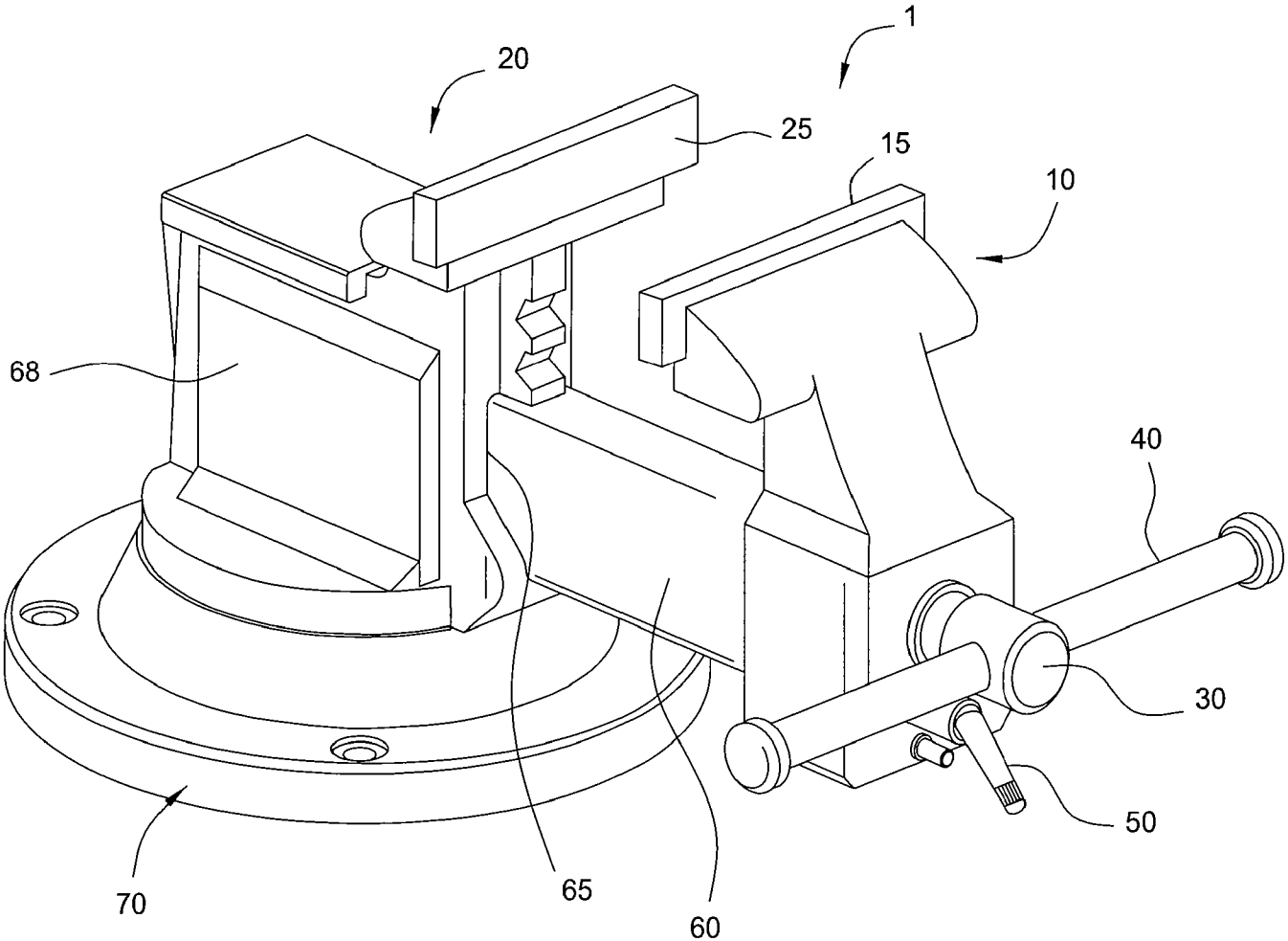
FIG. 1 illustrates a perspective view of a vise according to one embodiment of the present invention.

FIG. 1 illustrates a perspective view of a vise 1. The vise 1 includes a moveable jaw 10, a fixed jaw 20, a spindle 30, a handle 40, a lever 50, a channel 60 and a base 70. The moveable jaw 10 is configured to move toward and away from the fixed jaw 20 when the spindle 30 is rotated. The rotation of the spindle 30 in a first direction causes the moveable jaw 10 to move toward the fixed jaw 20. The rotation of the spindle 30 in a second direction causes the moveable jaw 10 to move away from the fixed jaw 20. The moveable jaw 10 moves very slow in response to the rotation of the spindle 30 due to a fine pitch of the threads on the spindle, as will be discussed in more detail below. The lever 50 allows a user to manually release spindle 30 from the fixed jaw 10. The release of the spindle 30 allows for free movement of the moveable jaw 10 relative to the fixed jaw 20. Thus, the lever 50 allows an operator to quickly release the spindle 30 then manually adjust the location of the moveable jaw 10. The lever 50 may then be manipulated to reengage the spindle 30 and move the moveable jaw 10 using the handle to rotate the spindle 30.

The moveable jaw 10 attaches to the channel 60. As shown, the moveable jaw 10 is fixed to the channel 60. Thus as the channel 60 moves, the moveable jaw 10 moves with it. The channel 60 is configured to move through an aperture 65 in a housing 68 coupled to the fixed jaw 20. Therefore, as the spindle 30 or the operator moves the channel 60 into and out of the aperture 65 the moveable jaw 10 moves toward and away from the fixed jaw 20.

The housing 68 couples to the fixed jaw 20 and the base 70. The base 70 is configured to couple the vise 1 to a surface such as a table. The base 70, as shown, has holes 80 adapted to couple the vise 1 to the surface with fasteners. The fasteners may be any suitable fastener including, but not limited to, screws, nails, or bolts. With the base 70 fastened to the surface, the housing 68 and the fixed jaw 20 remain stationary. The moveable jaw 10 and the channel 60 may be manipulated using the handle 40 and the lever 50 in order to quickly engage and disengage a workpiece between the jaws.

Figure 2:
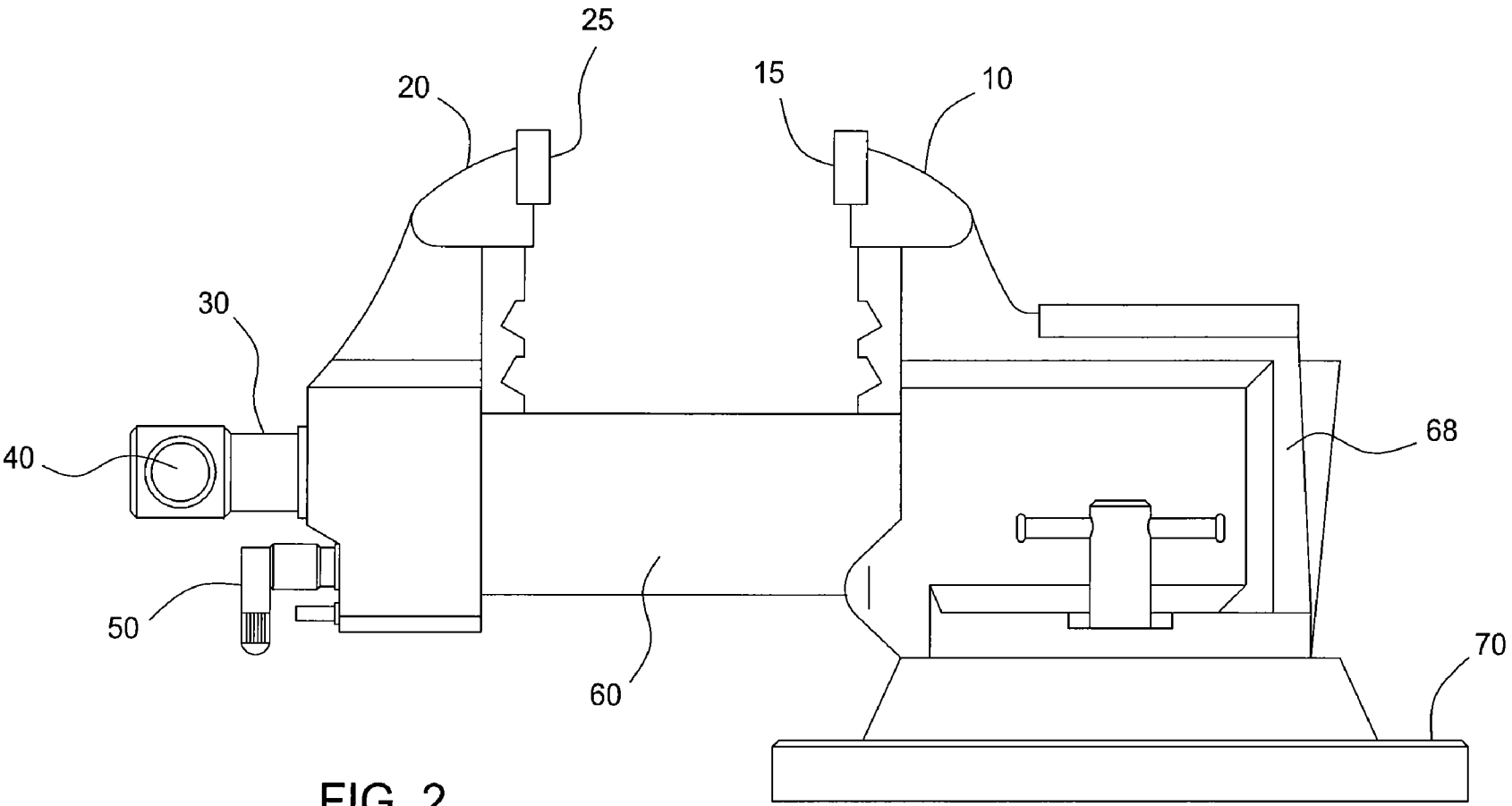
FIG. 2 illustrates a front view of a vise according to one embodiment of the present invention.

As shown in FIGS. 1 and 2, the fixed jaw 20 may include a gripping member 25. The moveable jaw 10 may include a gripping member 15 coupled to and moveable with the jaw. The gripping members 15 and 25 are configured to engage the workpiece. The gripping members 15 and 25 may have any suitable configuration or material so long as the gripping members are suited to engage and hold the workpiece between the jaws 10 and 20 when the moveable jaw 10 is moved close enough to the fixed jaw 20 to engage the workpiece.

Figure 3:
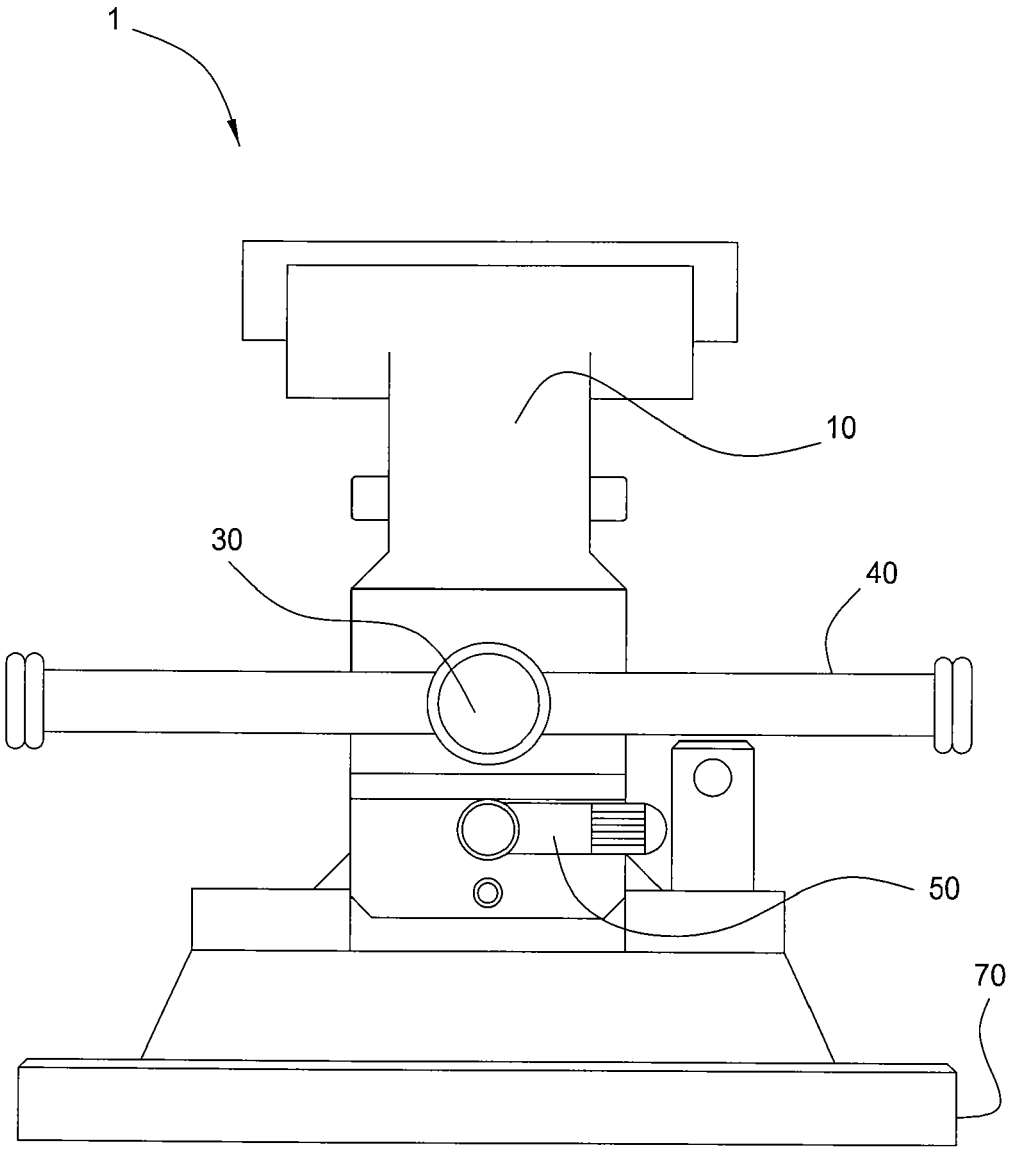
FIG. 3 illustrates an end view of a vise according to one embodiment of the present invention.

FIG. 3 shows an end view of the vise 1. The view shows the handle 40 and the lever 50 on the end of the moveable jaw 10. The lever 50 is shown in close proximity to the handle 40. The close proximity of the lever 50 and the handle 40 allows for the operator to operate the vise quickly with one hand located near the end of the moveable jaw 10. For example, the operator may operate the lever 50 to disengage the spindle 30 from the fixed jaw 20. The operator may then move the moveable jaw 10 to a desired position, for example in close proximity to a workpiece, using his hand. The operator may then reengage the spindle 30 with the fixed jaw 20 by manipulating the lever 50. With the fixed jaw 20 engaged with the spindle 30, the operator may manipulate the handle 40 in order to finely adjust the position of the moveable jaw 10 in relation to the workpiece.

FIG. 4 shows a cross sectional view of the vise 1. The moveable jaw 10 is shown fixed to the channel 60. The moveable jaw 10 is coupled to the spindle 30 and an actuation rod 420. The moveable jaw 10 includes a spindle aperture 400 and an actuation rod aperture 410. The spindle aperture 400 supports and guides the spindle 30 through the moveable jaw 10. The spindle aperture 400 is adapted to allow the spindle 30 to rotate about an axis X-X while restraining the longitudinal movement of the spindle 30. The actuation rod aperture 410 supports and guides the actuation rod 420 through the moveable jaw 10. The actuation rod aperture 410 allows the actuation rod 420 to rotate about an axis Y-Y while limiting the longitudinal movement of the actuation rod 420. Any suitable method may be used to restrain the longitudinal movement of the spindle 30 and the actuation rod 420 relative to the moveable jaw 10.

The spindle 30 has one or more threads 430 configured to engage an engagement profile 440 on a semi-nut 450. The one or more threads 430 as shown have a fine pitch that allows the moveable jaw 10 to move a very small distance when the spindle is rotated, although it should be appreciated that any suitable thread pitch may be used depending on the mechanical advantage sought for the vise 1. The handle 40 is adapted to allow the operator to easily rotate the spindle 30 in either direction. As the spindle 30 rotates, the threads 430 travel in the engagement profile 440 when the semi-nut 450 is engaged with the spindle 30. The semi-nut 450 is coupled to the fixed jaw 20 thereby moving the spindle 30 and the moveable jaw 10 as the threads 430 travel in the engagement profile 440. The rotation of the spindle 30 in the first direction moves the moveable jaw 10 toward the fixed jaw 20. The rotation of the spindle 30 in the second or opposite direction moves the moveable jaw 10 away from the fixed jaw 20.

The semi-nut 450 is moveably located within a semi-nut housing 460. The semi-nut housing 460, as shown, is coupled to the housing 68 of the fixed jaw 20. Any suitable method of connecting the semi-nut housing 460 to the fixed jaw 20 is contemplated including, but not limited to, welding, screwing, bolting, or gluing. The semi-nut housing 460 may include two apertures 462 and 464 configured to allow the spindle 30 and the actuation rod 420 to go though the semi-nut housing 460. The apertures 462 and 464 allow the spindle 30 and/or the actuation rod 420 to rotate and move longitudinally relative to the semi-nut housing 460 as the spindle 30 and actuation rod 420 are operated. The semi-nut 450 is adapted to move radially toward and away from the spindle 30, or up and down as shown in FIGS. 4A, 5A, 5B, 6A, and 6B. The semi-nut housing 460 limits the movement of the semi-nut 450 in a direction longitudinally along axis X-X. Thus, when the semi-nut 450 is engaged with the spindle 30 the threads 430 transfer longitudinal force to the engagement profile 440 of the semi-nut 450. The semi-nut 450 in turn transfers the force to the semi-nut housing 460 and the housing transfers the force to the housing 68 of the fixed jaw 20 which is fixed. This causes the spindle 30 to move the moveable jaw 10 relative to the fixed jaw 20.

Figures 4A, 4B:
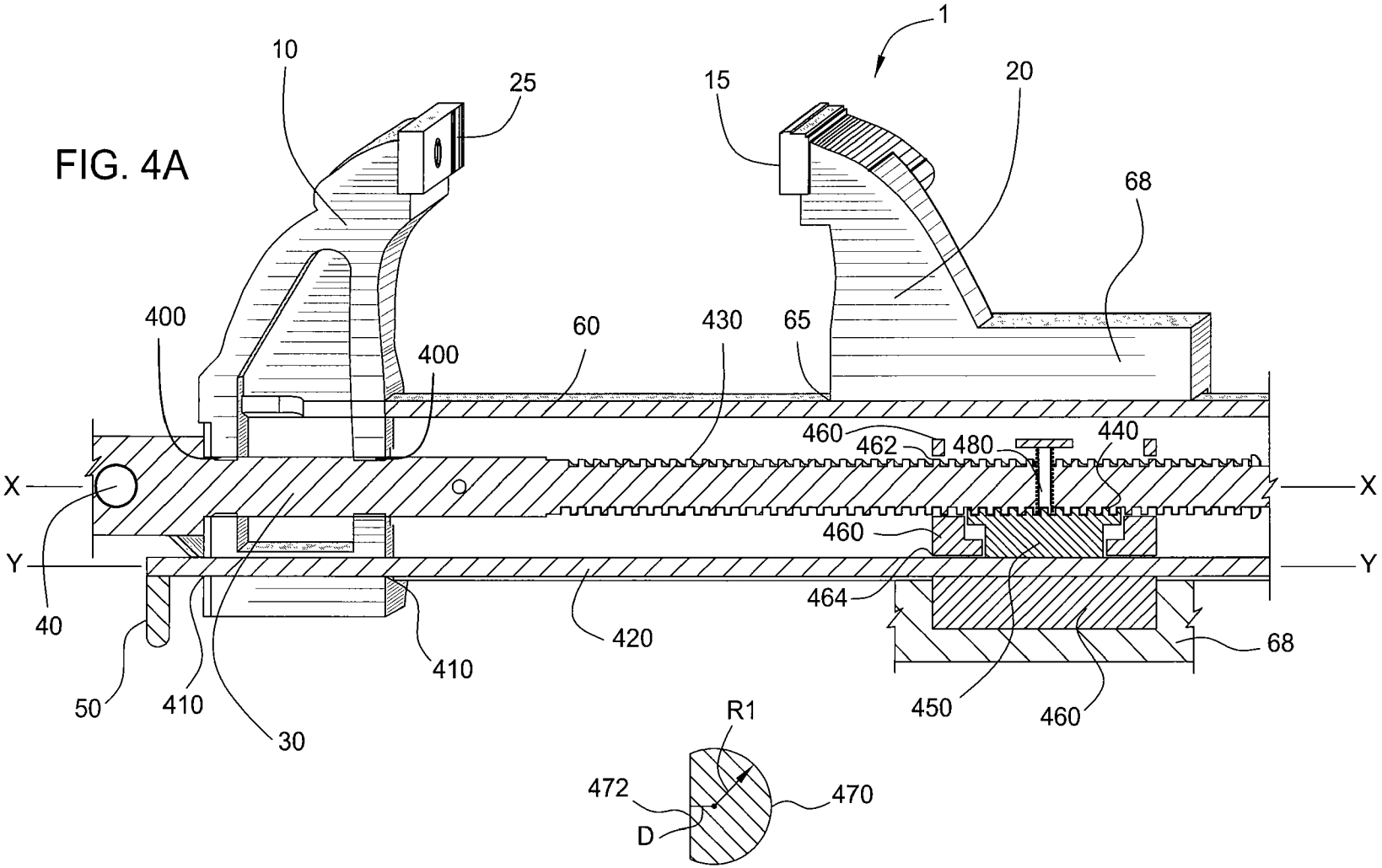
FIG. 4A illustrates a partial cross sectional view of a vise according to one embodiment of the present invention.
FIG. 4B illustrates a cross sectional view of an actuation rod according to one embodiment of the present invention.

The actuation rod 420 moves the semi-nut 450 into and out of engagement with the spindle 30. The actuation rod 420 couples to the lever 50. The lever 50 may be rotated in order to rotate the actuation rod 420 thereby actuating the semi-nut 450. The actuation rod 420 has a cross section (illustrated in FIG. 4B) configured to impart movement to the semi-nut 450 in a direction transverse to a rotational axis of the actuating rod 420. In one embodiment, the actuation rod 420 has a circular portion 470 and a flat portion, or surface, 472, as shown in FIG. 4B. The circular portion 470 of the actuation rod 420 has a radius R1 large enough to cause the semi-nut 450 to engage the spindle 30. Thus, when the circular portion 470 of the actuation rod is engaged with the semi-nut 450, the semi-nut 450 is engaged with the spindle 30. The flat portion 472 of the actuation rod 420 has a distance D1 from the center of the actuation rod 420 to the flat portion 472. Thus, the distance D1 reduces the distance to the edge of the actuation rod 420 near the flat portion 472. The distance of the radius R1 minus the distance D1 should be large enough to allow the engagement profile 440 of the semi-nut 450 to disengage the threads 430 of the spindle 30. Thus, when the flat portion 472 is engaged with the semi-nut 450, the semi-nut 450 is disengaged from the spindle 30. The circular portion 470 may encompass any suitable circumference of the actuation rod 420 so long as flat portion 472 reduces the Radius RI of the actuation rod 420 by the distance D large enough to move the semi-nut 450 out of engagement with the threads 430 of the spindle 30. In one embodiment, the actuation rod 420 has a substantially "D" shape cross section. The semi-circular configuration of the actuation rod 420 may extend the entire length of the actuation rod 420 or only on a portion of the actuation rod 420 which engages the semi-nut 450.

An optional biasing member 480 is configured to bias the semi-nut 450 toward a disengaged position. The biasing member 480 assists in the disengagement of the semi-nut 450 from the spindle 30. In operation, the jaws 10 and 20 may exert a considerable force on the workpiece. A portion of this force will be applied between the threads 430 of the spindle 30 and the engagement profile 440 of the semi-nut 450. This force may require a force larger than a gravity force in order to disengage the semi-nut 450 from the spindle 30. Therefore, the biasing member 480 assists in the disengagement of the semi-nut 450 from the spindle 30 when the actuation rod 420 is moved to the disengagement position. Any suitable number and orientation of biasing members 480 may be used. As shown, the biasing member 480 is a coiled spring surrounding a telescopic rod; however, it should be appreciated that any suitable biasing member may be used. When the vise 1 is placed upright on a horizontal surface, the biasing member 480 is assisted by gravity to disengage the semi-nut 450 from the spindle 30. The biasing member 480 may be configured to work in the absence of the assistance of gravity, for example when the vise 1 is mounted on a vertical surface or upside-down.

Figure 5A:
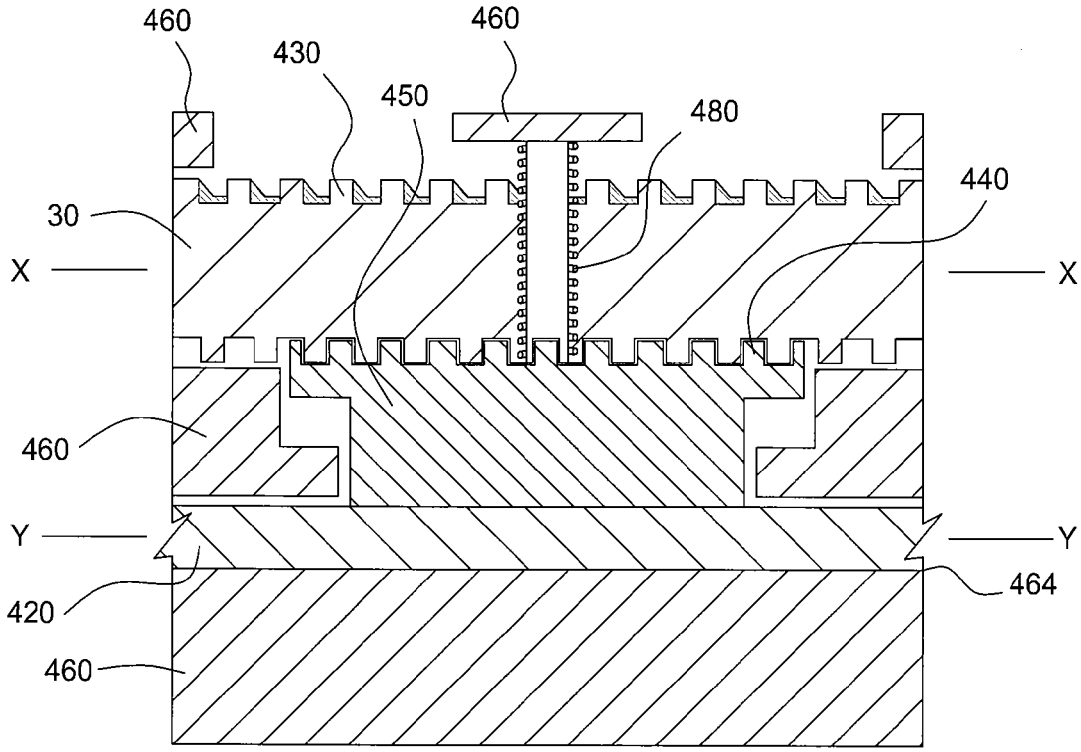
FIG. 5A is cross sectional view of a release mechanism according to one embodiment of the present invention.

FIG. 5A shows a cross-sectional view of the semi-nut housing 460 with the semi-nut 450. The engagement profile 440 of the semi-nut 450 is shown engaged with the threads 430 of the spindle 30. In this position, the circular portion 470 of the actuation rod 420 engages the bottom side of the semi-nut 450 and the bottom side of the aperture 464. The biasing member 480 provides a constant force on the semi-nut 450 toward the disengaged position. In this engaged position, the operator may finely adjust the location of the moveable jaw 10 using the handle 40 to rotate the spindle 30 as described above. The semi-nut 450 remains in this position until the operator desires to move the moveable jaw 10 quickly without using the spindle 30.

Figure 5B:
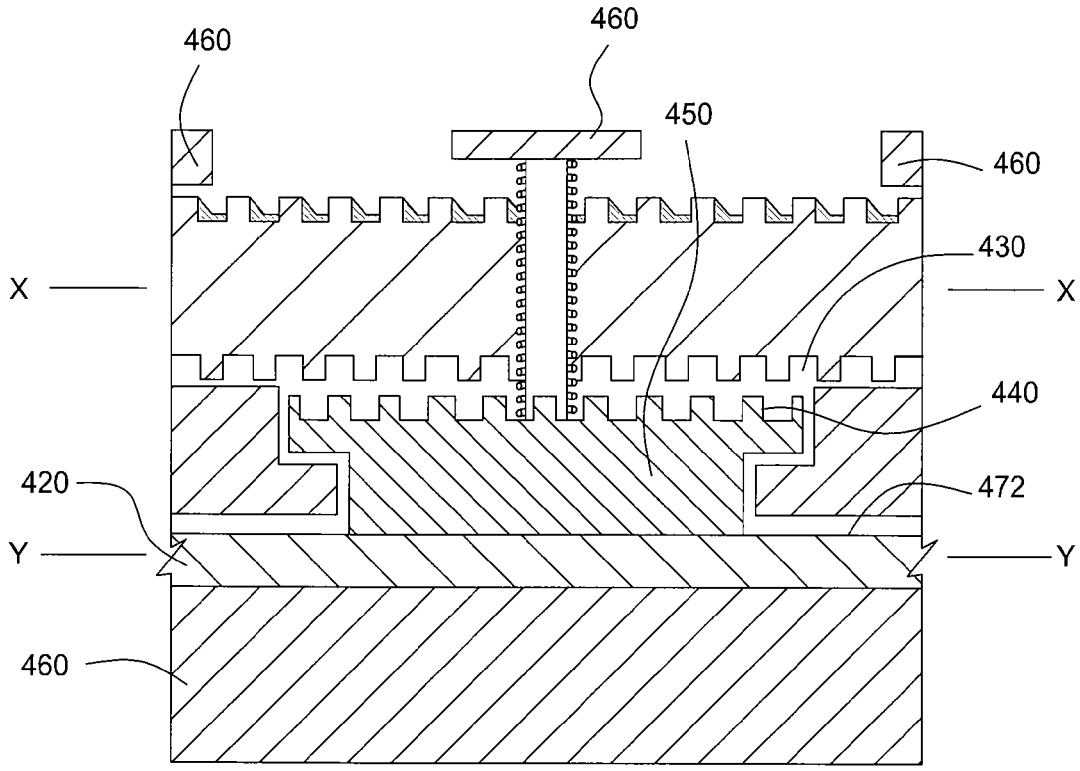
FIG. 5B is cross sectional view of a release mechanism according to one embodiment of the present invention.

When the operator desires to release the moveable jaw 10 from the fixed jaw 20, the operator rotates the lever 50 until the flat portion 472 of the actuation rod 420 is engaged with the semi-nut 450 as shown in FIG. 5B. In this disengaged position, the flat portion 472 provides enough space to allow the semi-nut 450 to disengage the spindle 30. The biasing member 480 may provide an additional disengagement force to the semi-nut 450. This additional force may assist in the disengagement of the semi-nut 450 from the spindle 30.

Figure 6A:
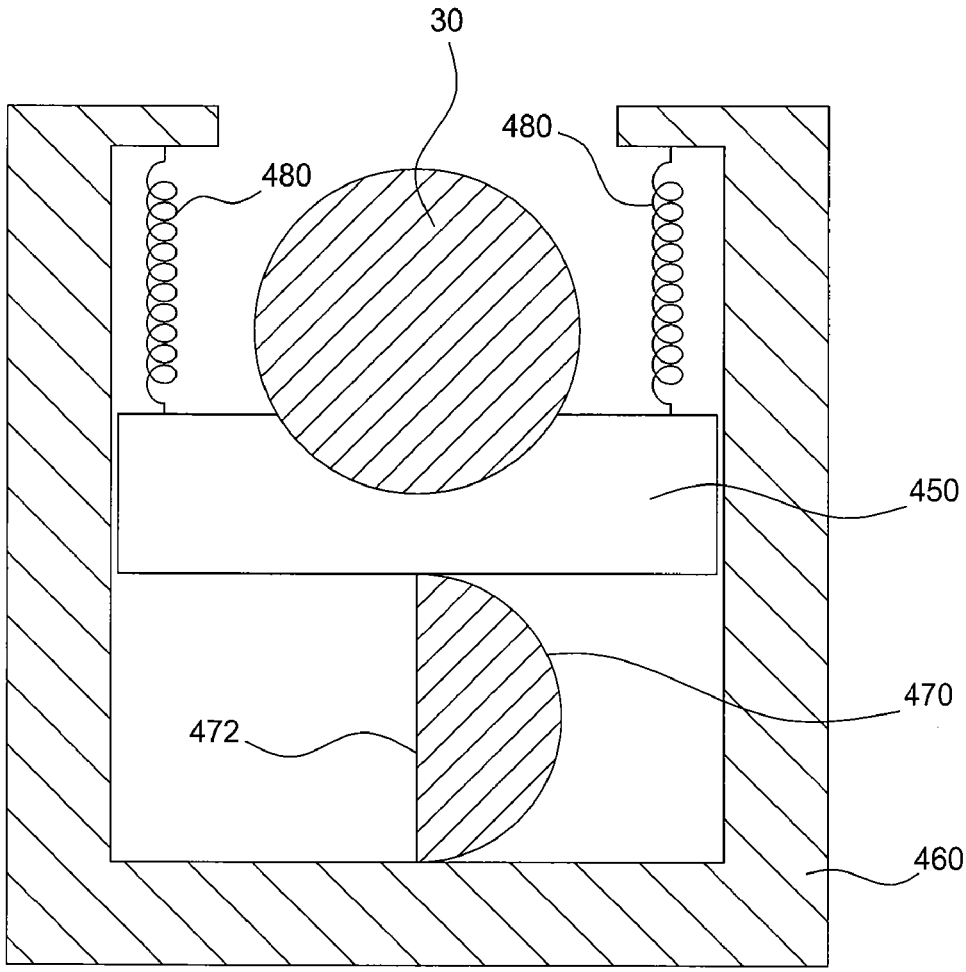
FIG. 6A is cross sectional view of a release mechanism according to one embodiment of the present invention.

FIG. 6A shows a cross-sectional view of the semi-nut housing 460 along the axis of the spindle 30. The semi-nut 450 is shown engaged with the spindle 30. In this position, the circular portion 470 engages both the semi-nut 450 and the semi-nut housing 460 in order to maintain the engaged position.

Figure 6B:
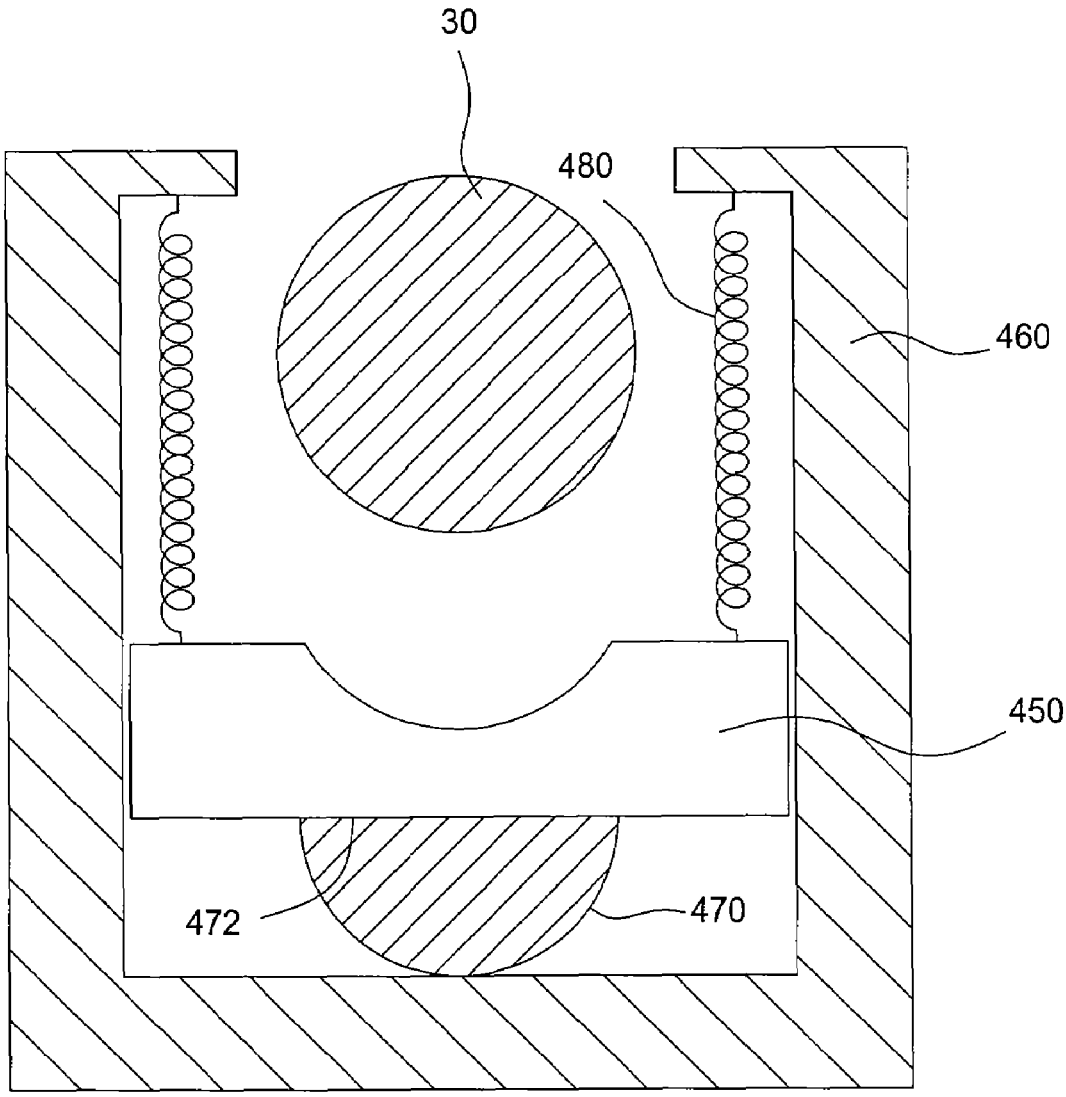
FIG. 6B is cross sectional view of a release mechanism according to one embodiment of the present invention.

FIG. 6B shows a cross-sectional view of the semi-nut housing 460 along the axis of the spindle 30. The semi-nut 450 is shown disengaged from the spindle 30. In this position, the flat portion 472 engages the semi-nut 450 and the circular portion 470 engages the semi-nut housing 460. The flat portion 472 allows enough space for the semi-nut 450 to disengage the spindle 30, as discussed above.

In one embodiment, the lever 50 and/or the actuation rod 420 includes a spring or biasing member (not shown) configured to bias the actuation rod 420 toward the engaged position. Thus, the spring will bias the actuation rod 420 toward a position wherein the circular portion 470 engages the semi-nut 450. The spring prevents the inadvertent release of the semi-nut 450 from the spindle 30. The spring may be coupled to the moveable jaw 10 and may include an end that wraps around the lever 50 to thereby provide the bias that returns the actuating rod 420 to the engaged position after being manually rotated to the disengaged position.

Figure 7:
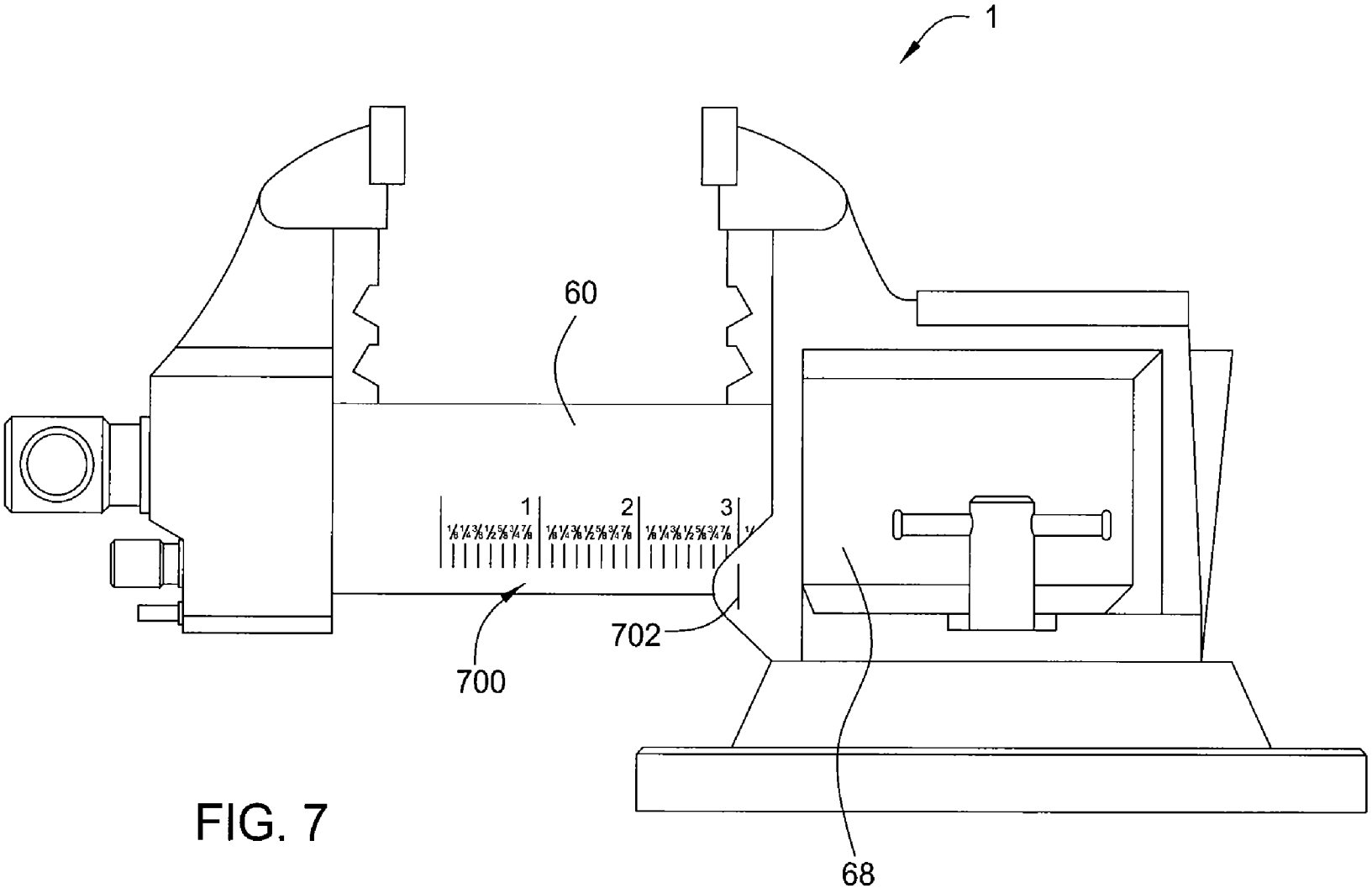
FIG. 7 illustrates a front view of a vise according to one embodiment of the present invention.

In an additional or alternative embodiment, the vise 1 includes a measurement indicator as shown in FIG. 7. The measurement indicator includes a length indicator 700 and a marker 702. The length indicator 700 is a series of marks on the channel 60 which correspond to a unit of measurement. As shown, the length indicator 700 is a series of distance markers starting at zero, with the distance being in inches. The marker 702 is a mark or indicator located on the housing 68 of the vise 1. The marker 702 lines up with the length indicator 700 in order to quickly display the distance the jaws 10 and 20 are apart. As shown, the marker 702 is in alignment with the 3 inch mark on the length indicator 700. This indicates to the operator that a face of each of the gripping members 15 and 25 are 3 inches apart. As the moveable jaw 10 is manipulated the location of the marker 702 is stationary as the length indicator 700 moves. Thus, as the operator moves the moveable jaw 10 toward and away from the fixed jaw 20, the marker 702 always indicates the distance between the faces of the gripping members 15 and 20. The length indicator 700, as shown, is in imperial units; however, it should be appreciated that the length indicator may be in any unit of measurement including, but not limited to, the metric system, international system (SI), and US customary units. It should be appreciated that the marker 702 may be adapted to indicate the distance between any of the features of the moveable jaw 10 and the fixed jaw 20 and not just the faces of the clamping members.

In operation, the vise is used to engage and disengage a workpiece quickly. The operator manipulates the lever 50 in order to disengage the moveable jaw 10 from the fixed jaw 20. The manipulation of the lever 50 rotates the actuation rod 420 until the flat portion 472 of the actuation rod is substantially facing the semi-nut 450. The semi-nut 450 moves away from the spindle 30 with the assistance of gravity and/or the biasing member 480. The engagement profile 440 disengages the threads 430 of the spindle 30 as the semi-nut moves down. With the threads 430 disengaged, the operator may adjust the moveable jaw 10 to a location close to the workpiece. Thus, the workpiece is now in close proximity with the fixed jaw 20 and the disengaged moveable jaw 10. The lever 50 may now be returned to the engaged position thereby rotating the actuation rod 420 until the semi-nut 450 is engaged with the spindle 30. The operator may now rotate the spindle 30 in the first direction in order to move the moveable jaw 10 towards the fixed jaw 20. This may be done until the workpiece is held between the jaws 10 and 20 with the desired force. In this position an operation may be performed on the workpiece. In order to release the workpiece, the operator manipulates the lever 50 until the flat portion of the actuation rod 420 is facing the semi-nut 450. Gravity and/or the biasing member assist in disengaging the semi-nut from the spindle as described above. With the semi-nut 450 disengaged from spindle 30, the operator may move the moveable jaw 10 away from the fixed jaw 20. The workpiece is no longer engaged between the jaws and the operator may repeat this process to perform another operation on another workpiece.

While the foregoing is directed to embodiments of the present invention, other and further embodiments of the invention may be devised without departing from the basic scope thereof, and the scope thereof is determined by the claims that follow.

The invention claimed is:

1. A vise, comprising:

a fixed jaw having a first gripping surface;

a moveable jaw having a second gripping surface;

a spindle for providing movement of the moveable jaw relative to the fixed jaw;

a semi-nut configured to selectively engage the spindle; and an actuation rod configured to move the semi-nut between an engaged position and a disengaged position with the spindle, wherein the actuation rod has an actuation portion configured to engage and manipulate the semi-nut and an actuation end having a mechanism configured for manual manipulation by a user in order to engage and disengage the semi-nut and wherein the actuation portion has an axial cross section which comprises a circular portion and a flat portion whereby rotating the actuation rod to a first position causes the circular portion to engage a bottom portion of the semi-nut thereby moving the semi-nut to the engaged position and rotating the actuation rod to a second position causes the flat portion to engage the bottom portion of the semi-nut thereby moving the semi-nut to the disengaged position.

2. The vise of claim 1, wherein the axial cross section has the shape of a D.

3. The vise of claim 2, wherein the axial cross section extends the length of the actuating rod.

4. The vise of claim 1, wherein the circular portion encompasses a majority of the circumference of the actuating rod.

5. The vise of claim 1, further comprising a spring configured to bias the semi-nut toward the disengaged position.

6. The vise of claim 1, further comprising a lock configured to secure the actuating rod in a position wherein the semi-nut engages the circular portion.

7. The vise of claim 1, further comprising a measurement indicator located on the channel configured to correspond to a marker located on a housing of the fixed jaw.

8. A vise, comprising:

a fixed jaw having a first gripping surface;

a moveable jaw having a second gripping surface;

a spindle for providing movement of the moveable jaw relative to the fixed jaw;

a semi-nut configured to selectively engage the spindle thereby mechanically coupling the moveable jaw to the fixed jaw; and a rotatable actuation rod configured to move the semi-nut between an engaged position and a disengaged position with the spindle, wherein the actuation rod has an axial cross section which comprises a circular portion and a flat portion, wherein the semi-nut is in the engaged position when the semi-nut engages the spindle and the circular portion of the actuation rod engages a bottom portion of the semi-nut, and the semi-nut is in the disengaged position when the semi-nut disengages the spindle and the flat portion of the actuation rod engages the bottom portion of the semi-nut;

a first biasing member configured to bias the semi-nut toward a disengaged position; and a second biasing member configured to bias the actuation rod toward an engaged position.

9. The vise of claim 8, wherein the first biasing member is a plurality of coiled springs.

10. A vise comprising:

a fixed jaw having a first gripping surface;

a housing configured to couple the fixed jaw to a base of the vise, wherein the base is configured to couple the vise to a surface;

a moveable jaw having a second gripping surface;

a channel coupled to the moveable jaw and adapted to travel through an aperture of the housing as the moveable jaw moves toward and away from the fixed jaw;

a spindle for providing movement of the moveable jaw relative to the fixed jaw;

a semi-nut configured to selectively engage the spindle;

an actuation rod configured to move the semi-nut between an engaged position and a disengaged position, whereby rotating the actuation rod to a first position causes a circular portion of the actuation rod to engage a bottom portion of the semi-nut thereby moving the semi-nut to the engaged position and rotating the actuation rod to a second position causes a flat portion of the actuation rod to engage the bottom portion of the semi-nut thereby moving the semi-nut to the disengaged position; and a measurement indicator located on the channel configured to correspond to a marker located on a housing, wherein the marker is configured to align with a measurement indicator thereby allowing an operator to quickly determine the distance between the fixed jaw and the moveable jaw.

* * * * *